US007661998B1

(12) United States Patent
Sypolt et al.

(10) Patent No.: US 7,661,998 B1
(45) Date of Patent: Feb. 16, 2010

(54) ELECTRICAL CONTACT FOR INTERCONNECTING ELECTRICAL COMPONENTS

(75) Inventors: Matthew Sypolt, Harrisburg, PA (US); James Lee Fedder, Etters, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/246,189

(22) Filed: Oct. 6, 2008

(51) Int. Cl.
*H01R 13/42* (2006.01)

(52) U.S. Cl. ..... 439/751

(58) Field of Classification Search ..... 439/571, 439/78, 751
See application file for complete search history.

(56) References Cited

U.S. PATENT DOCUMENTS 4,017,143 A 4/1977 Knowles
4,381,134 A 4/1983 Anselmo et al.
4,776,807 A * 10/1988 Triner et al. ..... 439/82
5,487,684 A * 1/1996 Schalk et al. ..... 439/751
5,667,412 A 9/1997 Takahashi et al.
5,738,550 A 4/1998 Sakuraoka et al.
6,309,228 B2 10/2001 Otsuki et al.
6,565,367 B2 5/2003 Budman et al.
7,160,122 B2 1/2007 Larsen et al.

FOREIGN PATENT DOCUMENTS

DE 3633013 4/1988

OTHER PUBLICATIONS

C-Press® "True" Compliant Press-Fit Connectors; Winchester Electronics-C-Press Technology; http://www.winchesterelectronics.com/products/cpress; 2008; 2 pgs.

* cited by examiner

*Primary Examiner*—Phuong K Dinh

(57) ABSTRACT

An electrical contact configured to engage an electrical component. The contact includes a compressive body that is configured to be press-fit into a hole of the electrical component. The body includes a center portion and a pair of opposing arcuate arms that extend along a central axis. The arcuate arms project from the center portion to respective end portions and are configured to bend toward each other when inserted into the hole. The arcuate arms form a transition region and a compliant region of the body where the transition region engages the hole before the compliant region. The end portions of the transition region have a first arcuate path and the end portions of the compliant region have a second arcuate path. The second arcuate path has a greater radius of curvature than the first arcuate path before the body is inserted into the hole.

20 Claims, 8 Drawing Sheets

ELECTRICAL CONTACT FOR INTERCONNECTING ELECTRICAL COMPONENTS

BACKGROUND OF THE INVENTION

The subject matter herein relates to electrical contacts for interconnecting electrical components and, more particularly, to contacts that are press-fit into holes to mechanically and electrically couple the components.

Electrical contacts may be used to mechanically and electrically connect electrical components (e.g., circuit boards, conductors, electrical connectors) to one another. For example, U.S. Pat. No. 4,017,143 to Knowles ("Knowles") describes one known electrical contact that is used to electrically couple a connector to a printed circuit board. The contact is configured to be press-fit into a plated thru-hole of the circuit board. The contact includes a central section having a C-shaped cross-section that is formed by oppositely extending arcuate arms. The arcuate arms taper as the arms extend away from each other to corresponding ends. The C-shaped central section merges with a long wire-wrap tail section that extends a distance away from the central section and forms a tip at a front end of the contact. In order for the contact to engage the hole, the tail section is first inserted into an opening of the hole and advanced therethrough. After the tail section advances a distance into the hole, the arcuate arms engage the opening of the hole and bend toward each other. When the contact is fully inserted, the arcuate arms of the C-shaped cross-section are conformed to the shape of the hole and are electrically coupled to a conductive path therein.

Although the contact described in Knowles is able to interconnect the printed circuit board and the connector, it may be necessary to carefully maneuver the connector and/or contacts due to the long tail section. If the tail section is not properly inserted into the hole, the contacts may become damaged or misaligned. Furthermore, the contact described in Knowles does not provide an initial tactile indication that the contact has engaged the hole.

Accordingly, there is a need for electrical contacts that may be more easily inserted into corresponding holes than known contacts. There is also a need for electrical contacts that provide a tactile indication that the contacts have engaged the holes.

BRIEF DESCRIPTION OF THE INVENTION

In one embodiment, an electrical contact configured to engage an electrical component is provided. The contact includes a compressive body that is configured to be press-fit into a hole of the electrical component. The body includes a center portion and a pair of opposing arcuate arms that extend along a central axis. The arcuate arms project from the center portion to respective end portions and are configured to bend toward each other when inserted into the hole. The arcuate arms form a transition region and a compliant region of the body where the transition region engages the hole before the compliant region. The end portions of the transition region have a first arcuate path and the end portions of the compliant region have a second arcuate path. The second arcuate path has a greater radius of curvature than the first arcuate path before the body is inserted into the hole.

Optionally, each arcuate arm has an arc length that extends from the center portion to the respective end portion. The arc lengths of the arcuate arms may be greater in the transition region than in the compliant region. Also, the end portions of the transition region may be closer together than the end portions of the compliant region after the body is inserted into the hole. In addition, the arcuate arms may have a thickness where the thickness of the arcuate arms at the end portions in the transition region are smaller than the thickness of the arcuate arms proximate to the center portion in the transition region. Furthermore, the thickness of the arcuate arms at the end portions in the transition region may be smaller than the thickness of the arcuate arms at the end portions in the compliant region.

In another embodiment, an electrical contact configured to engage an electrical component is provided. The contact includes a compressive body that is configured to be press-fit into a hole of the electrical component. The body includes a center portion and a pair of opposing arcuate arms that extend along a central axis. The arcuate arms project from the center portion and are configured to bend toward each other when inserted into the hole. The arcuate arms form a transition region and a compliant region and have a cross-sectional shape that is substantially U-shaped in the compliant region and a cross-sectional shape that is substantially C-shaped before the body is inserted into the hole. The transition region engages the hole before the compliant region.

Optionally, the arcuate arms may also form a lead-in region that extends away from the transition region. The cross-sectional shape of the lead-in region may be smaller than the cross-sectional shape of the transition region. Also, the cross-sectional shape of the lead-in region may be different than the cross-sectional shape of the transition region. Furthermore, the lead-in region may include an end of the body that has a substantially planar surface that is transverse to the central axis.

In another embodiment, an electrical connector assembly configured to engage an electrical component having an array of plated through-holes is provided. The connector assembly includes a dielectric structure that has an array of cavities. The connector assembly also includes an array of electrical contacts. Each contact is held in a corresponding cavity of the dielectric structure. Each contact includes a compressive body that is configured to be press-fit into a corresponding through-hole of the electrical component. The body includes a center portion and a pair of opposing arcuate arms that extend along a central axis. The arcuate arms project from the center portion and are configured to bend toward each other when inserted into the through-hole. The arcuate arms of each contact form a transition region and a compliant region where each region has at least one of a different size and a different cross-sectional shape than the other region. The array of contacts provide a tactile indication that the transition region of each contact is compressed within the corresponding through-hole prior to the compliant region being inserted into the through-hole.

In some embodiments, the array of contacts may be configured to engage through-holes of a circuit board.

DETAILED DESCRIPTION OF THE INVENTION

Figure 1:
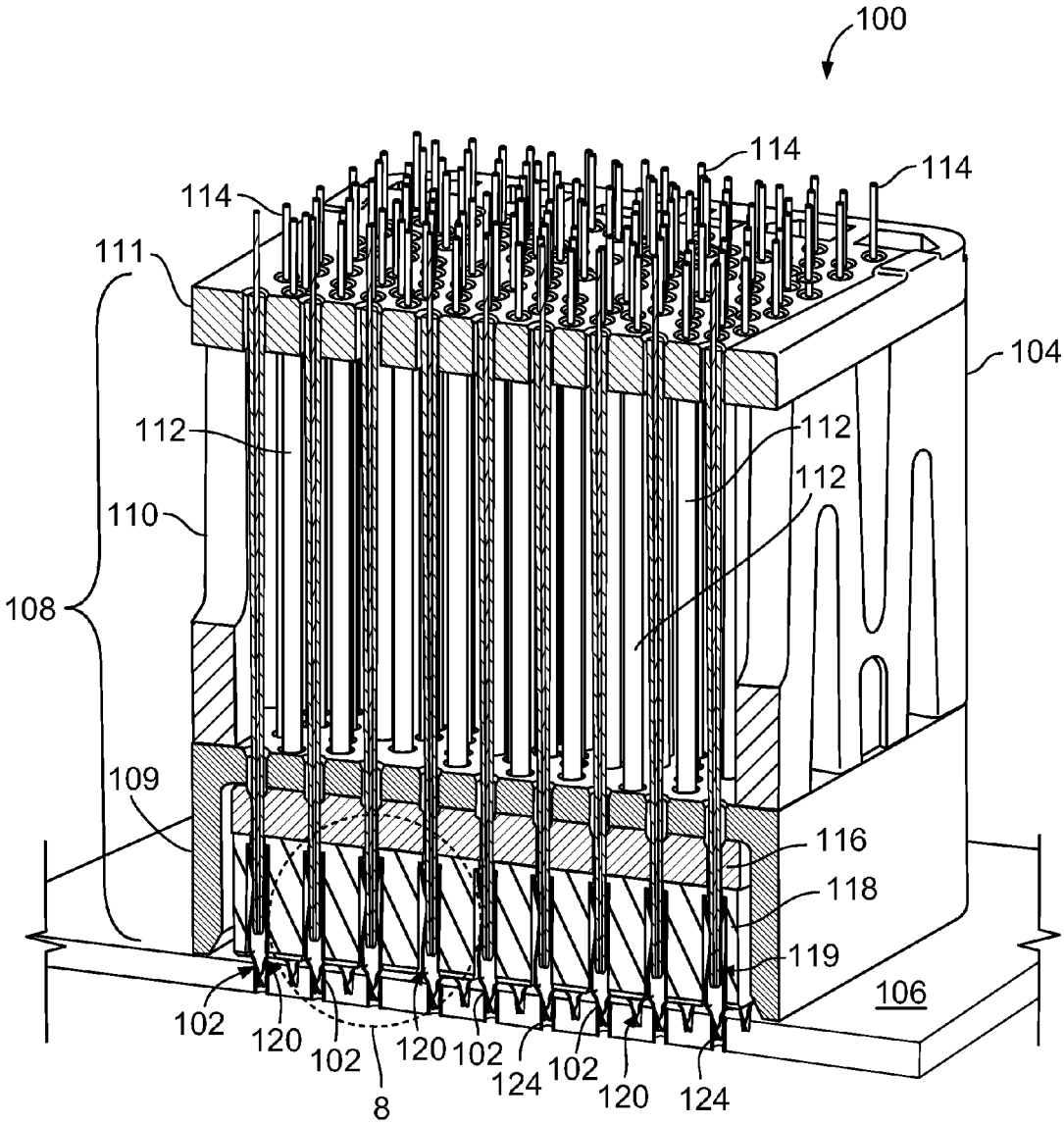
FIG. 1 is a cross-sectional perspective view of an electrical connector assembly using electrical contacts formed in accordance with one embodiment.

FIG. 1 is a cross-sectional perspective view of an electrical connector assembly 100 using an array of electrical contacts 102 formed in accordance with one embodiment. The connector assembly 100 includes an electrical connector 104 engaged with an electrical component 106 through the contacts 102 and a dielectric structure 118, which is shown as a receptacle 119. Although the component 106 is illustrated as a circuit board in FIG. 1, the component 106 may be other electrical components that are capable of engaging the contacts 102. In the illustrated embodiment, each contact 102 has a compressive body 130 (FIG. 2) that is configured to be inserted (i.e., press-fit) into and engage a corresponding plated through-hole 124 of the component 106 to provide an electrical connection between the connector 104 and the component 106. Before the contact 102 is press-fit into the corresponding through-hole 124, the body 130 is in an uncompressed state or condition. When the contact 102 is press-fit into the through-hole 124, the body 130 conforms into a compressed state or condition.

While the connector assembly 100 and the contacts 102 are described herein with particular reference to FIGS. 1-9, it is to be understood that the benefits herein described are also applicable to other connectors in alternative embodiments and to other electrical components that utilize the contacts 102. For example, alternative connector assemblies may only include the dielectric structure 118 and the contacts 102. Also, the dielectric structure 118 may be a separate part or may be integrally formed with the connector 104. As such, the following description is therefore provided for purposes of illustration, rather than limitation, and is but one potential application of the subject matter herein.

In the illustrated embodiment shown in FIG. 1, the connector 104 may include a housing 108 that is constructed from a plurality of housing elements 109-111. In the illustrated embodiment, the housing 108 includes a shroud element 109, an intermediate element 110, and a base element 111. The housing 108 encases a plurality of conductors 112 that extend through the housing 108. The conductors 112 have tails 114 that project outwardly away from the base element 111. The conductors 112 and corresponding tails 114 may be arranged in an array having any desired configuration. The connector 104 also includes an organizer 116 for supporting the conductors 112 within the housing 108.

The connector assembly 100 also includes the receptacle 119 that is configured to hold the array of contacts 102 and engage the component 106. As shown, the receptacle 119 has cavities 120 that are configured to receive and hold the contacts 102. To construct the connector assembly 100, an operator or machine may move the receptacle 119 to engage the component 106. Each contact 120 projecting from the receptacle 119 is inserted into a corresponding through-hole 124 such that the receptacle 119 is held adjacent to the component 106. After the receptacle 119 is electrically and mechanically coupled to the component 106, the connector 104 is coupled to the receptacle 119. Specifically, the shroud element 109 is inserted over the receptacle 119 and each conductor 112 is inserted into a corresponding cavity 120 where a corresponding contact 102 is located.

Figure 2:
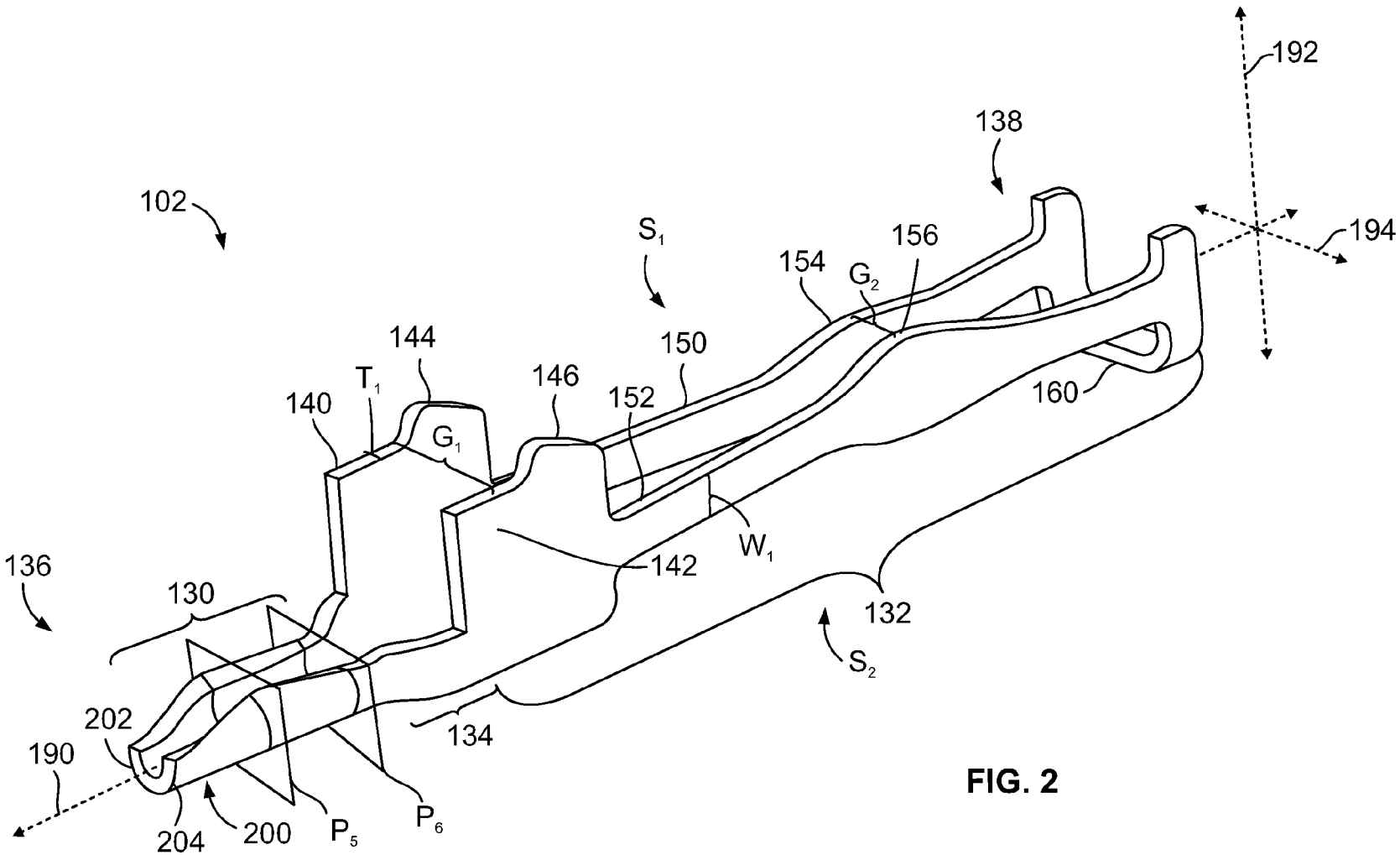
FIG. 2 is a perspective view of the contact that may be used with the connector assembly shown in FIG. 1.
Figure 3:
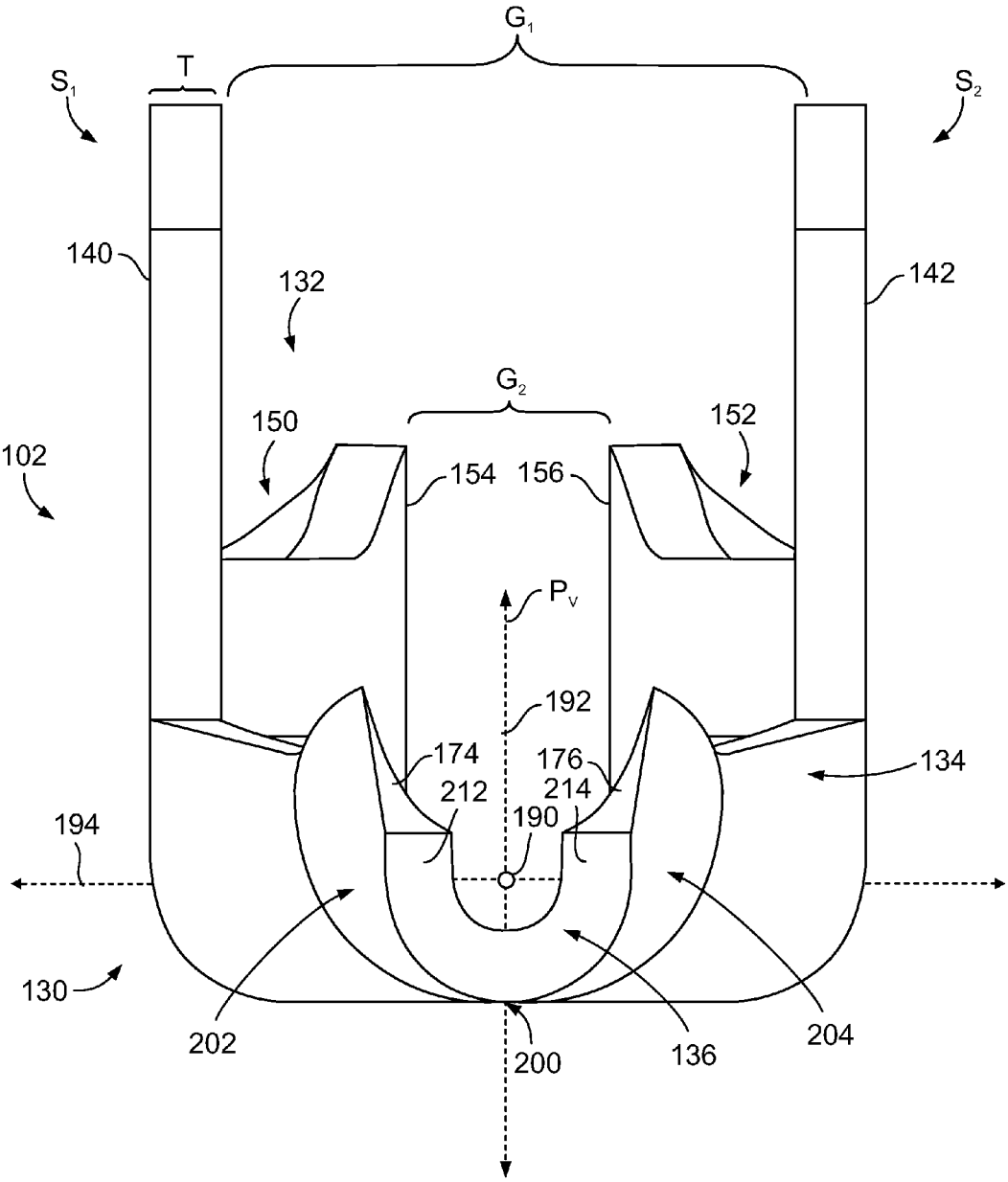
FIG. 3 is a front view of the contact shown in FIG. 2.
Figure 4:
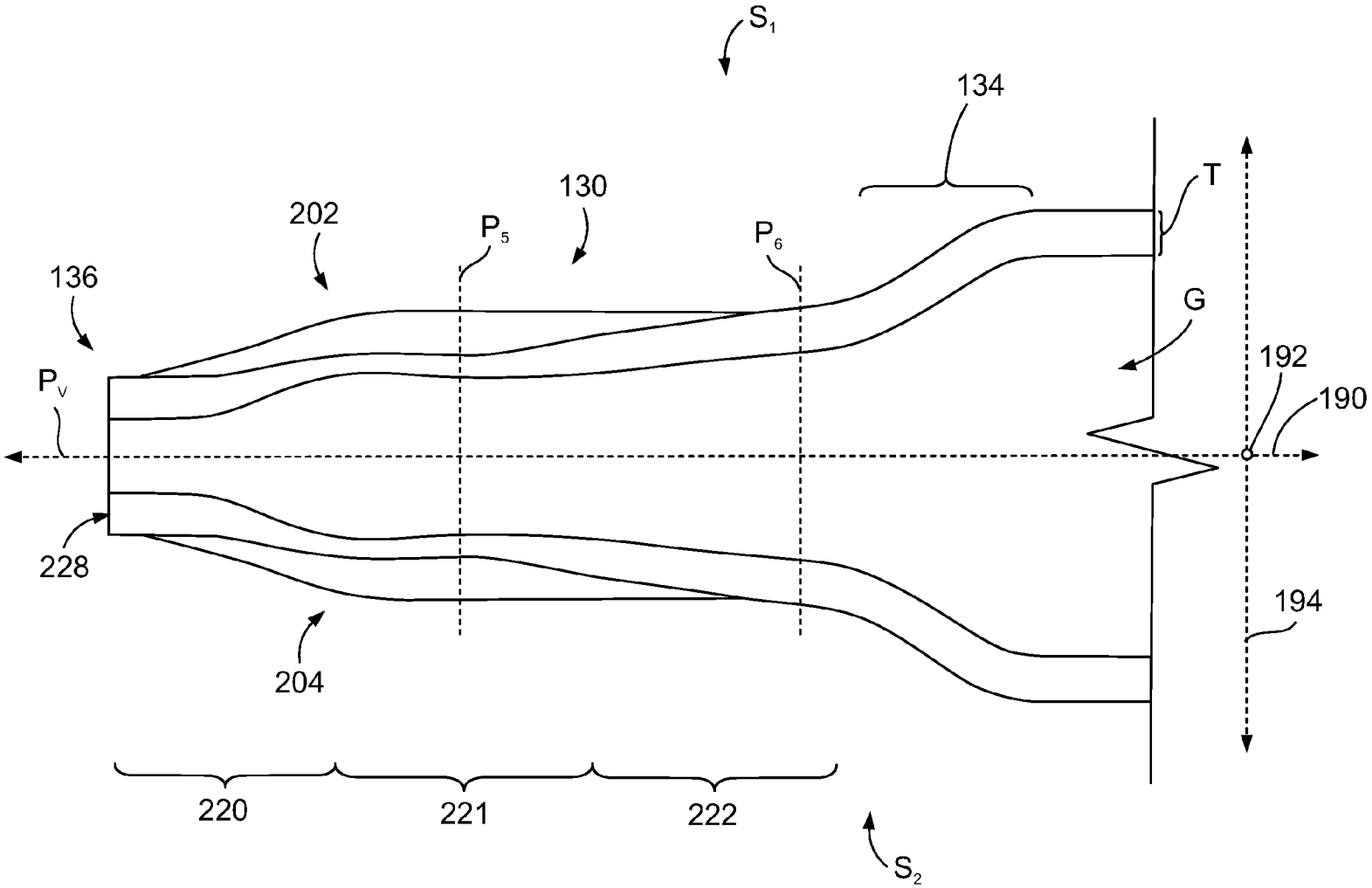
FIG. 4 is a top view of a compressive body of the contact shown in FIG. 2.

FIGS. 2-6 illustrate the contact 102 in an uncompressed condition (i.e., before the contact 102 is inserted into the through-hole 124 (FIG. 1) of the component 106). FIG. 2 is a perspective view of the contact 102, FIG. 3 is a front view of the contact 102, and FIG. 4 is a top view of the body 130. The contact 102 is described relative to a central axis 190, a lateral axis 194, and a vertical axis 192 in FIG. 2. As shown, the contact 102 has a front end 136 and a back end 138 (FIG. 2) and extends along the central axis 190 between the front and back ends 136 and 138. The contact 102 includes the body 130 proximate to the front end 136, a base portion 132 (FIGS. 2 and 3) proximate to the back end 138, and an intermediate portion 134 that extends between the body 130 and the base portion 132. When the body 130 is inserted into the through-hole 124, the body 130 compresses and at least partially conforms to a shape of the through-hole 124 and forms an electrical connection with conductive paths (not shown) of the component 106. As such, electrical signals and/or power may be transmitted through the contacts 102 between the connector 104 and the component 106.

As shown, the contact 102 may be formed around the central axis 190 such that two sides $S_1$ and $S_2$ are formed. The sides $S_1$ and $S_2$ may oppose each other and be separated by a vertical plane $P_v$ (FIGS. 3 and 4) formed by the central and vertical axes 190 and 192 such that a gap G is formed therebetween. (Gap G is illustrated at two separate points $G_1$ and $G_2$ in FIGS. 2 and 3.) Furthermore, the contact 102 may have a varying or constant thickness T. The thickness T may be constant in certain areas or regions and reduced/enlarged in other areas or regions to facilitate bending of the contact 102. Alternatively, the thickness T is substantially constant throughout. The contact 102 may be stamped and formed (e.g., rolled) from sheet metal to include the features and regions described herein. However, the contact 102 may also be manufactured with alternative methods.

With reference to FIG. 2, the base portion 132 is configured to be inserted into the corresponding cavity 120 (FIG. 1) of the receptacle 119 (FIG. 1). The base portion 132 includes a pair of opposing shoulders 140 and 142 that extend along the vertical axis 192 and are separated from each other by the gap $G_1$. The shoulders 140 and 142 may include retention barbs 144 and 146. When the base portion 132 is inserted into the cavity 120, the shoulders 140 and 142 and the retention barbs 144 and 146 may facilitate holding the contact 102 in a fixed position within the cavity 120.

Also shown in FIG. 2, the base portion 132 may include beams 150 and 152 that extend from the shoulders 140 and 142, respectively, along the central axis 190 to a bridge member 160. In the illustrated embodiment, the beams 150 and 152 oppose each other across the gap G. The bridge member 160 joins and holds the beams 150 and 152 in position relative to each other. The beams 150 and 152 may also form bulbous portions 154 and 156, respectively, where a width $W_B$ of the respective beam is greater in the corresponding bulbous portion than other portions of the beam. Furthermore, as shown in FIG. 3, the beams 150 and 152 may extend inward toward each other such that the gap $G_2$ in the base portion 132 is shortest between the bulbous portions 154 and 156. As will be discussed further below, the bulbous portions 154 and 156 of each contact 102 may electrical couple to a corresponding conductor 112 within the housing 108.

However, the description of the base portion 132 is only one example and is not intended to be limiting. Alternative embodiments of the base portion 132 that mechanically and electrically connect the contact 102 to the receptacle 119 and/or the connector 104 may be used. For example, the base portion 132 may have similar features and regions as described below with respect to the body 130. In such an embodiment, the base portion 132 may be inserted into the cavity 120, which may compress the base portion 132.

The body 130 may include one or more features and/or regions that facilitate making a mechanical and electrical connection with the component 106. As shown in FIGS. 2 and 3, the body 130 includes a center portion 200 that extends along the central axis 190 from the front end 136 to the shoulders 140 and 142, respectively. The center portion 200 is a region of the body 130 that joins two arcuate arms 202 and 204. In the illustrated embodiment, the center portion 200 extends in a linear manner throughout the body 130. Alternatively, the center portion 200 may turn within the vertical plane $P_v$ or curve outside the vertical plane $P_v$ in a lateral direction.

As shown, the pair of arcuate arms 202 and 204 project from the center portion 200 and extend along the central axis 190 between the front end 136 and the shoulders 140 and 142, respectively. The center portion 200 may be an elongated depression formed between the arcuate arms 202 and 204 that extends across the gap G (FIG. 4). The arcuate arms 202 and 204 may be on separate sides $S_1$ and $S_2$ of the contact 102 and oppose each other across the gap G. The arcuate arms 202 and 204 extend from the center portion 200 to end portions 212 and 214, respectively. For example, in one embodiment, the center portion 200 intersects the vertical plane $P_v$. The arcuate arms 202 and 204 project outwardly from the center portion 200 along the plane formed by the axes 192 and 194. In the illustrated embodiment, the arcuate arms 202 and 204 are substantially symmetrical to each other with respect to the vertical plane $P_v$.

As will be described in further detail below, the body 130 and the arcuate arms 202 and 204 may have one or more features that facilitate inserting the body 130 into the corresponding through-hole 124 (FIG. 1). For example, with reference to FIG. 4, the body 130 may form a plurality of body regions 220-222 along the central axis 190, including a lead-in region 220, a transition region 221, and a compliant region 222. The compliant region 222 of the body 130 projects from the intermediate portion 134 toward the front end 136. The body 130 then forms into the transition region 221 from the compliant region 222, and then may form into the lead-in region 220 from the transition region 221. In one embodiment, the lead-in region 220 and/or the front end 136 has a planar surface 228 that is transverse to the central axis 190 (i.e., extends along a plane formed by the lateral axis 194 and the vertical axis 192). When the connector 104 (FIG. 1) and the contacts 102 are first moved toward the component 106 to interlock the two, the planar surface 228 may facilitate sliding/maneuvering the contacts 102 along a surface of the component 106. When the contacts are properly aligned with the through-holes 124, the lead-in region 220 is the first to clear the through-hole 124. However, the lead-in region 220 as described herein is only optional and alternative embodiments may not have the lead-in region 220.

Figure 5:
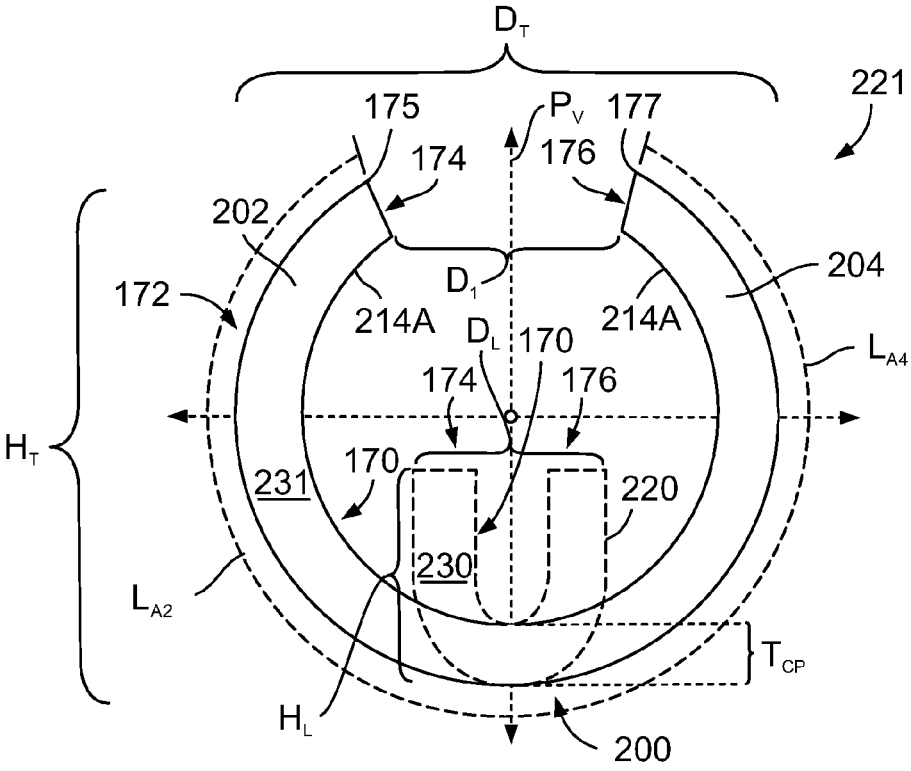
FIG. 5 illustrates a cross-section of a transition region of the contact when the compressive body is in an uncompressed condition.
Figure 6:
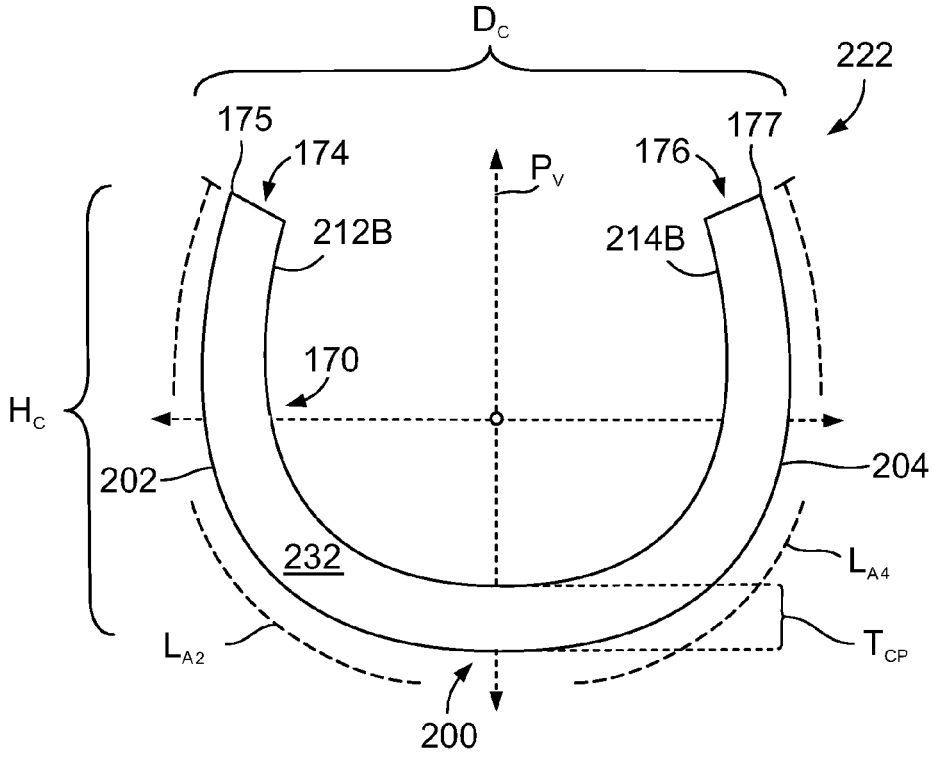
FIG. 6 illustrates a cross-section of a compliant region of the contact when the compressive body is in an uncompressed condition.

FIGS. 5 and 6 are cross-sectional views of the transition region 221 and the compliant region 222 taken along planes $P_5$ and $P_6$ shown in FIG. 2, which extend parallel to the plane formed by the lateral and vertical axes 194 and 192 (FIG. 2) and are transverse to the central axis 190. For illustrative purposes, FIG. 5 also includes a phantom outline of a cross-section of the lead-in region 220. As shown in FIGS. 5 and 6, the body 130 has an inner body surface 170, which may come, for example, from one side of the sheet metal before the contact 102 is formed and an outer body surface 172 that may come from the other side of the sheet metal. The body 130 may also have a pair of edge surfaces 174 and 176 that join the inner and outer surfaces 170 and 172. The edge surface 174 and the outer surface 172 join each other along a mating edge 175 and the edge surface 176 and the outer surface 172 join each other along a mating edge 175. In the uncompressed condition, the edge surfaces 175 and 176 are a distance $D_1$ (FIG. 5) apart from each other in the transition region 221. Furthermore, although not shown in FIGS. 5 and 6, the gap G along the body 130 is defined by the inner body surface 170.

The arcuate arms 202 and 204 in the transition region 221 may be sized and shaped to facilitate bending the arcuate arms 202 and 204 in the compliant region 222 when the body 130 is press-fit into the corresponding through-hole 124. For example, as shown in FIG. 5, the transition region 221 may have a maximum width or diameter $D_T$ measured along the lateral axis 194 between the outer surface 172 of the arcuate arm 202 and the outer surface 172 of the arcuate arm 204. The transition region 221 may also have a maximum height $H_T$ measure from the center portion 200 along the vertical axis 192 to the edge surfaces 174 and 176. Likewise, the compliant region 222 may have a maximum width or diameter $D_C$ and a maximum height $H_C$, and the lead-in region 220 may have a width or diameter $D_L$ and a height $H_L$ measured at the planar surface 228 (FIG. 4). In the illustrated embodiment, before the body 130 is press-fit into the corresponding through-hole 124, the diameters $D_T$ and $D_C$ may be substantially equal to each other, but the height $H_T$ may be greater than the height $H_C$. Furthermore, the diameter $D_L$ and height $H_L$ of the lead-in region 220 may be substantially less than the diameter $D_L$ and $H_T$ of the transition region 221, respectively. Also shown, the center portion 200 of the transition region 221 may have a thickness $T_{CP}$.

In addition, the arcuate arms 202 and 204 may have arc lengths $L_{A2}$ and $L_{A4}$, respectively. The arc lengths LA extend from the center portion 200 to the edge surface 174 and 176, respectively. In the illustrated embodiment, the arc lengths $L_{A2}$ and $L_{A4}$ are substantially equal to each other within the same cross-section. However, as shown in FIGS. 5 and 6, the arc lengths $L_{A2}$ and $L_{A4}$ may be longer in the transition region 221 than in the compliant region 222.

In addition to the maximum diameters $D_T$ and $D_C$, maximum heights $H_T$ and $H_C$, and arc lengths $L_{A2}$ and $L_{A4}$, the body 130 may have varying cross-sectional shapes within the different body regions 220-222. For example, FIGS. 5 and 6 illustrate a cross-sectional shape 231 in the transition region 221 and a cross-sectional shape 232 in the compliant region 222, respectively. In the illustrated embodiment, the cross-sectional shape 231 may be substantially C-shaped and the cross-sectional shape 232 may be substantially U-shaped. As shown in FIGS. 5 and 6, the end portions 212A and 214A of the transition region 221 may be curved more inwardly toward each other than the end portions 212B and 214B of the compliant region 222. More specifically, the edge surfaces 174 and 176 may substantially face the vertical plane $P_V$ while in the transition region 221 and may face a direction that is substantially parallel to (or only slightly toward) the vertical plane $P_V$ in the compliant region 222.

Also shown in FIG. 5, the lead-in region 220 may have a cross-sectional shape 230 that is similar to or different than the cross-sectional shapes 231 and 232. For example, the cross-sectional shape 230 of the lead-in region 220 may have a similar geometric shape (e.g., U-shape or C-shape) as the cross-sectional shapes 231 and 232, but may have a substantially smaller size. In the illustrated embodiment, the body 130 begins as a U-shape in the lead-in region 220, forms into a C-shape in the transition region 221, and then forms into a U-shape in the compliant region 222.

With reference again to FIG. 3, beginning at the front end 136, in the illustrated embodiment the edge surfaces 174 and 176 initially face an upward direction that is substantially parallel to the vertical plane $P_V$. As the body 130 extends from the front end 136 to the transition region 221 (FIG. 4), the edge surfaces 174 and 176 and/or the end portions 212 and 214 may tilt toward the vertical plane $P_V$. When the body 130 forms into the compliant region 222 (FIG. 4) the edge surfaces 174 and 176 tilt outward (i.e., away from the vertical plane $P_V$). As such, the body 130 may provide a transition region 221 that is sized and shaped to facilitate bending the arcuate arms 202 and 204 in the compliant region 222 when the body 130 is press-fit into the corresponding through-hole 124.

Figure 7:
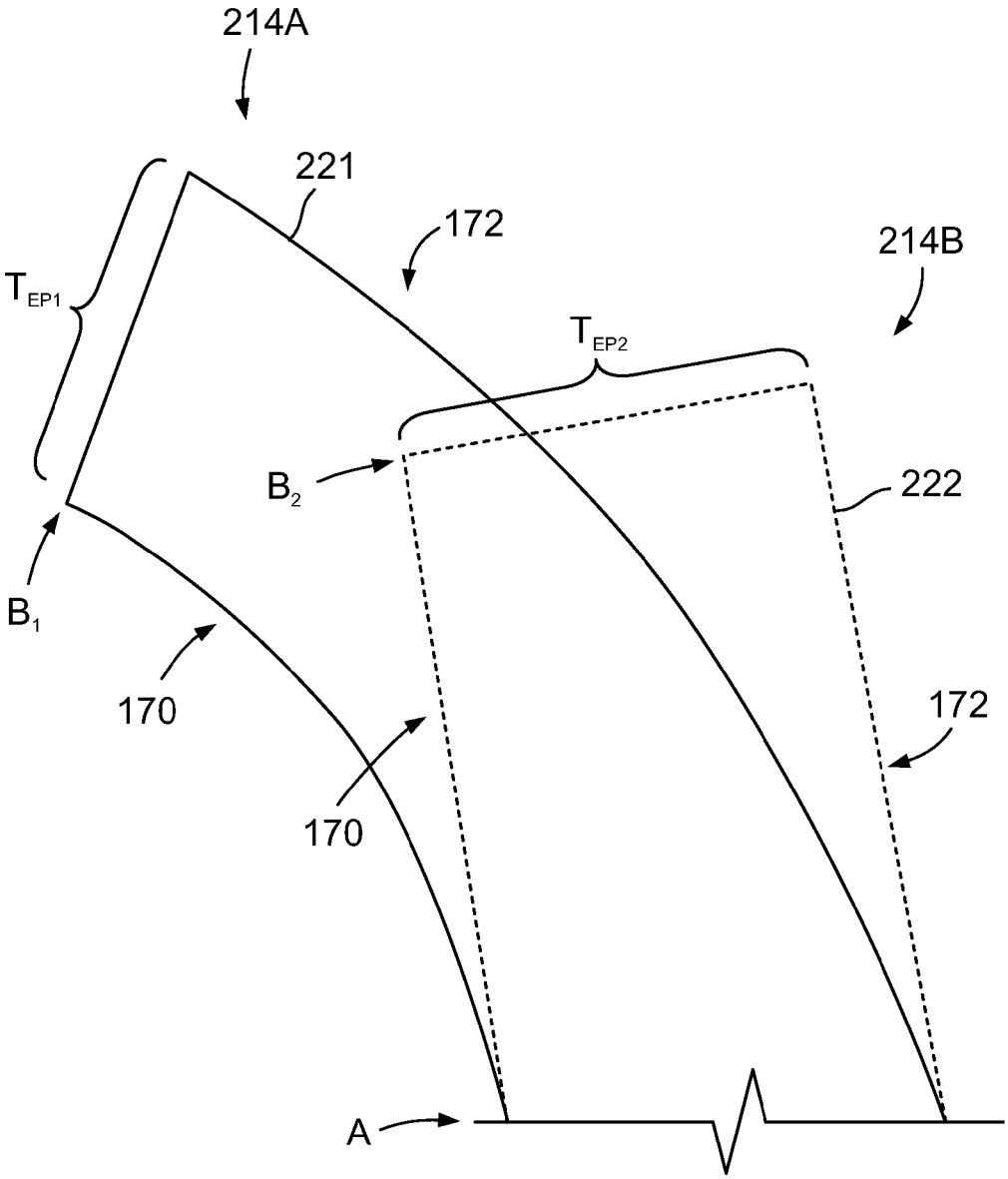
FIG. 7 illustrates arcuate paths of an end portion in the transition and compliant regions.

FIG. 7 illustrates the end portion 214 in the transition region 221 (indicated as end portion 214A) and the compliant region 222 (indicated as the end portion 214B). The transition region 221 is illustrated by solid lines and the compliant region 222 is illustrated by hashed-lines. Although the following is with specific reference to the end portion 214, the description may similarly be applied to the end portion 212. As shown in FIG. 7, the end portion 214 extends along the inner surface 170 from a point A to a point B. Specifically, the end portion 214 extends from point A to point $B_1$ in the transition region 221 and from point A to point $B_2$ in the compliant region 222. Point A in both the transition and compliant regions 221 and 222 may be a common distance or arc length from the center portion 200 (FIG. 2). As shown, the end portion 214 has different arcuate paths within the transition and compliant regions 221 and 222. For example, the arcuate path in the compliant region 222 may have a greater radius of curvature than the arcuate path in the transition region 221 (i.e., the transition region 221 curves more tightly than the compliant region 222). Furthermore, the arc length between points A and $B_1$ may be longer than the arc length between points A and $B_2$. In the illustrated embodiment, the arcuate path in the transition region 221 of the end portion 214 has both a smaller radius of curvature and a longer arc length.

Figure 8:
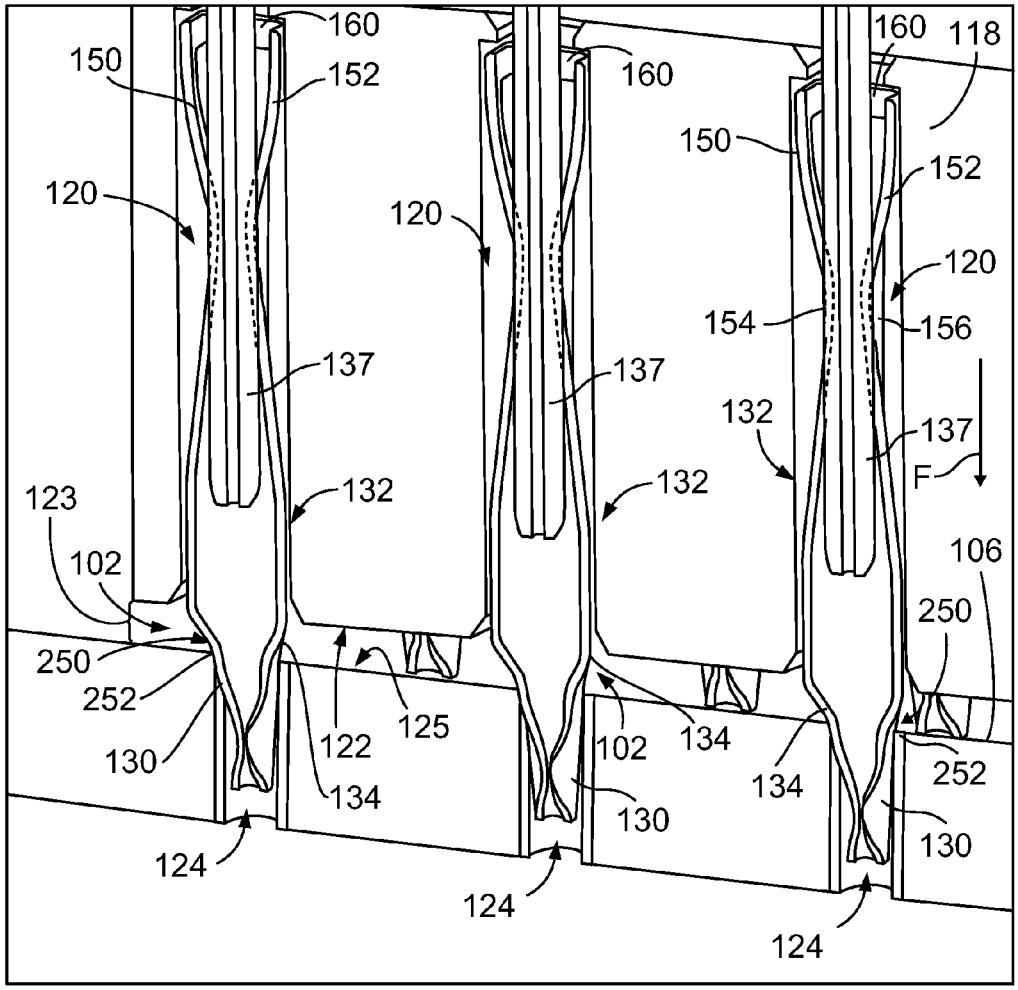
FIG. 8 is an enlarged view of the connector assembly shown in FIG. 1.

Furthermore, the end portion 214 may have a thickness $T_{EP1}$ in the transition region 221 and a thickness $T_{EP2}$ in the compliant region 222. In the illustrated embodiment, the thickness $T_{EP1}$ is slightly smaller than the thickness $T_{CP}$ (FIG. 5) of the center portion 200. For example, the thickness $T_{EP1}$ may be 10% smaller than the thickness $T_{CP}$. As such, in embodiments where the thickness $T_{EP1}$ of the transition region 221 is smaller than the thickness $T_{CP}$, the arcuate arms 202 and 204 (FIGS. 5 and 6) may be more easily bent inward toward each other when the transition region 221 engages the through-hole 124 (FIG. 8). Furthermore, in some embodiments, the thickness $T_{EP1}$ in the transition region 221 may be slightly smaller than the thickness $T_{EP2}$ in the compliant region 222.

FIG. 8 is an enlarged view of the of the connector assembly 100 shown in FIG. 1 illustrating the contacts 102 in a compressed condition within the corresponding through-holes 124. As shown, when the receptacle 119 is coupled to the component 106, a stand-off gap 123 is formed between a surface 122 of the receptacle 119 and a surface 125 of the component 106. The contacts 102 project outwardly from the receptacle 119. As shown, the base portion 132 of each contact 102 is configured to engage an inner surface of the corresponding cavity 120. The conductors 112 (FIG. 1) include conductor tails 137 that are inserted through the bridge member 160 and electrically contact the beams 150 and 152 of each base portion 132. The conductor tail 137 may engage the bulbous portions 154 and 156 causing the corresponding beams 150 and 152 to deflect outwardly toward walls of the cavity 120.

As shown, the through-holes 124 have an opening 250 defined by an opening edge 252. The body 130 of each contact 102 may be inserted into the corresponding through-hole 124 with an insertion force F. When the connector 104 (FIG. 1) and the corresponding contacts 102 are moved to engage the through-holes 124 of the component 106, the lead-in regions 220 (FIG. 4) of each contact 102 may facilitate inserting the contacts 102 into the corresponding through-holes 124. Due to the size and shape of the lead-in regions 220 and front end 136 (FIG. 2), even if the bodies 130 projecting from the mating face 122 are slightly misaligned with the corresponding through-holes 124, each body 130 may still advance into the corresponding through-hole 124. Furthermore, the planar surfaces 228 (FIG. 4) of the lead-in regions 220 may prevent the bodies 130 from bending or being damaged when the lead-in regions slide along the surface of the component 106.

Figure 9:
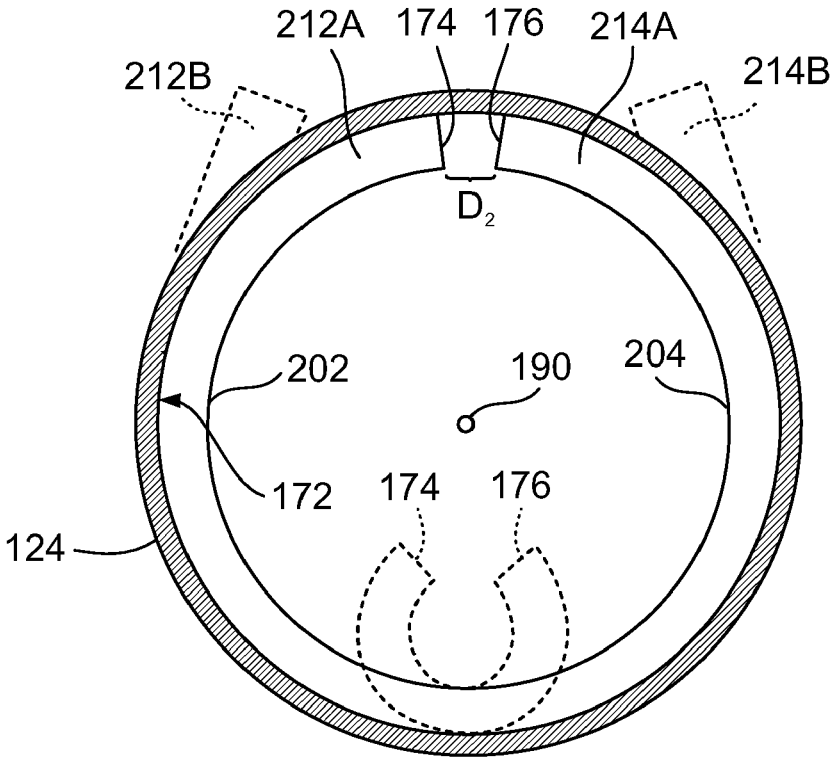
FIG. 9 illustrates the cross-section of the transition region shown in FIG. 5 when the body is in an initial insertion stage.
Figure 10:
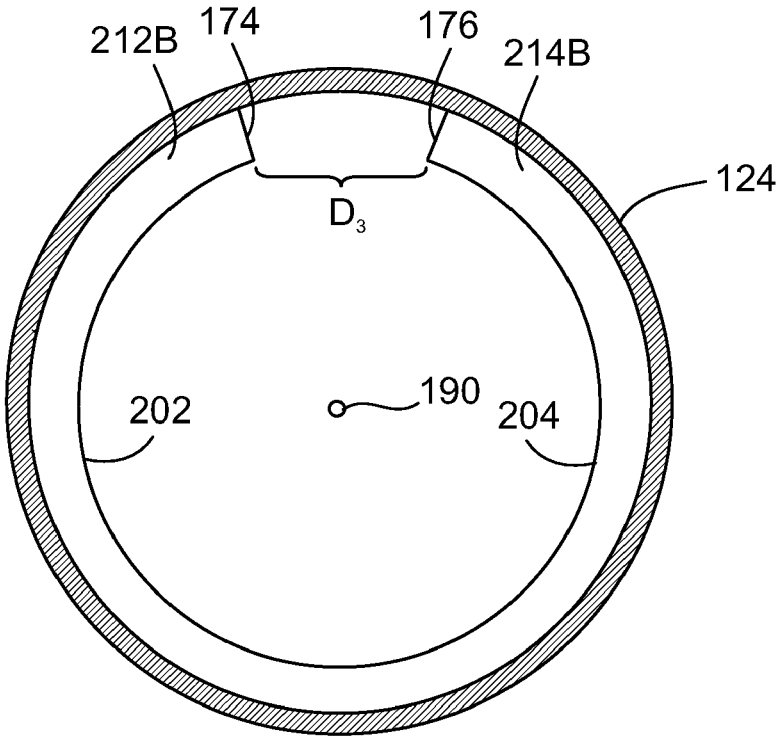
FIG. 10 illustrates the cross-section of the compliant region shown in FIG. 6 when the compressive body is in a compressed condition.

FIGS. 9 and 10 are the cross-sections of the body 130 (FIG. 2) shown in FIGS. 5 and 6, respectively. FIG. 9 illustrates when the body 130 is at an initial insertion stage (i.e., when the transition region 221 (FIG. 3) is in a compressed condition but the compliant region 222 (FIG. 3) is not fully compressed). FIG. 10 illustrates the body 130, specifically the compliant region 222, in a fully compressed condition. When advancing into the through-hole 124, an insertion force F (FIG. 8) moves the end portions 212A and 214A to engage the opening edge 252 (FIG. 8). The mating edges 175 and 177 (FIGS. 5 and 6) may first engage the opening edge 252. Due to the configuration of the arcuate arms 202 and 204 in the transition region 221, the end portions 212A and 214A compress or bend inward toward the central axis 190 such that the transition region 221 conforms into the shape of the through-hole 124. Due to the size and shape, the arcuate arms 202 and 204 in the transition region 221 may bend more easily than the arcuate arms 202 and 204 in the compliant region 222.

As shown in FIG. 9, when the body 130 is in the initial insertion stage, the end portions 212B and 214B of the compliant region 222 are not yet within the through-hole 124. The initial stage may provide a tactile indication to an operator of the receptacle 119, that the array of contacts 102 have initially engaged and are properly aligned with the corresponding array of through-holes 124. In other words, because the force F necessary to insert the transition regions 221 of the bodies 130 into the initial stage is less than the force F necessary to insert the bodies 130 fully into the through-holes 124, the resistance by the compliant region 222 after the transition region 221 is inserted indicates to the operator that the array of contacts 102 are in the initial insertion stage. In the initial insertion stage, the receptacle 119 may be loosely coupled to the component 106 because the arcuate arms 202 and 204 in the transition region 221 have engaged the through-holes 124. With the tactile indication that the contacts 102 are properly aligned, the operator may insert the bodies 130 into the corresponding through-holes 124. When the bodies 130 are fully inserted into the corresponding through-holes 124, the contacts 102 may provide a gas-tight seal (i.e., stable interface) between the body 130 and the through-hole 124.

In the illustrated embodiment, the outer surface 172 of the body 130 has a substantially circular shape around the central axis 190 when inserted into the through-hole 124. As shown in FIGS. 9 and 10, when the arcuate arms 202 and 204 are in the compressed condition, the edge surfaces 174 and 176 are a distance $D_2$ apart. The distance $D_2$ is less than the distance $D_1$ shown in FIG. 5. Furthermore, the arcuate arms 202 and 204 in the compliant region 222 are a distance $D_3$ apart. The distance $D_3$ is greater than the distance $D_2$.

In one embodiment, the contacts 102 may have smaller dimensions than other known contacts, such as the contacts described in Knowles. For example, the contacts 102 may be configured to fit into a through-hole that has a diameter of approximately less than 1.00 mm or less than 0.50 mm (e.g., approximately 0.35 mm).

It is to be understood that the above description is intended to be illustrative, and not restrictive. The above-described embodiments (and/or aspects thereof) may be used in combination with each other. For example, the body regions 220-222 may include additional regions that may or may not differ in size and/or shape from the other regions. As one example, the body 130 may include more than one transition region. Furthermore, the body 130 may include a long tail section similar to those used in known electrical contacts.

In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical contact configured to engage an electrical component, the contact comprising:

a compressive body configured to be press-fit into a plated through-hole of the electrical component, the body including a center portion and a pair of opposing arcuate arms that extend along a central axis, the arcuate arms projecting from the center portion to respective end portions and being configured to bend toward each other when inserted into the through-hole, the arcuate arms forming a transition region and a compliant region of the body where the transition region engages the through-hole before the compliant region, the end portions of the transition region having a first arcuate path and the end portions of the compliant region having a second arcuate path, wherein the second arcuate path has a greater radius of curvature than the first arcuate path before the body is inserted into the through-hole, the arcuate arms of the transition region bending toward each other when the arcuate arms of the transition region engage the through-hole and are compressed by the through-hole.

2. The contact in accordance with claim 1 wherein the end portion of each arcuate arm in the transition region interfaces with the through-hole when the body is fully inserted therein, wherein each arcuate arm has an arc length that extends from the center portion to the respective end portion, the arc lengths of the arcuate arms being greater in the transition region than the compliant region.

3. The contact in accordance with claim 1 wherein the end portion of each arcuate arm in the transition region interfaces with the through-hole when the body is fully inserted therein, wherein the end portions of the transition region are closer together than the end portions of the compliant region after the body is press-fit into the through-hole.

4. The contact in accordance with claim 1 wherein the arcuate arms in the transition region are sized and shaped to facilitate bending the arcuate arms in the compliant region when the body is inserted into the through-hole.

5. The contact in accordance with claim 1 wherein the body has an outer surface that extends continuously between the end portions of the opposite arcuate arms, the outer surface having a substantially circular shape when the body is inserted into the through-hole, the outer surface interfacing with the through-hole.

6. The contact in accordance with claim 1 further comprising a lead-in region that extends away from the transition region, wherein the lead-in region includes an end of the body and has a substantially planar surface that is transverse to the central axis.

7. The contact in accordance with claim 1 wherein a cross-section of the entire body in the transition region is substantially C-shaped and a cross-section of the entire body in the compliant region is substantially U-shaped before the body is inserted into the through-hole.

8. The contact in accordance with claim 7 wherein the transition region and the compliant region each have a maximum width that is measured between outer surfaces of the arcuate arms in the corresponding region, the maximum widths being substantially equal before the body is inserted into the through-hole.

9. The contact in accordance with claim 7 further comprising a lead-in region that extends away from the transition region, the lead-in region having cross-section that is substantially U-shaped.

10. The contact in accordance with claim 1 wherein the body is stamped and formed from sheet metal, the sheet metal having opposite first and second sides, the first side forming an inner surface of the body and the second side forming an outer surface of the body, the outer surface interfacing with the through-hole and the inner surface defining a gap that separates the arcuate arms.

11. The contact in accordance with claim 10 wherein the arcuate arms have a thickness, the thickness of the arcuate arms at the end portions in the transition region being smaller than the thickness of the arcuate arms proximate to the center portion in the transition region.

12. The contact in accordance with claim 1 wherein the radiuses of curvature of the first and second arcuate paths are substantially equal to each other when the body is fully inserted into the through-hole.

13. The contact in accordance with claim 1 wherein the center portion has a substantially common thickness throughout the transition and compliant regions.

14. An electrical contact configured to engage an electrical component, the contact comprising:

a compressive body configured to be press-fit into a plated through-hole of the electrical component the body including a center portion and a pair of opposing arcuate arms that extend along a central axis the arcuate arms projecting from the center portion to respective end portions and being configured to bend toward each other when inserted into the through-hole, the arcuate arms forming a transition region and a compliant region of the body where the transition region engages the through-hole before the compliant region, the end portions of the transition region having a first arcuate path and the end portions of the compliant region having a second arcuate path, wherein the second arcuate path has a greater radius of curvature than the first arcuate path before the body is inserted into the through-hole, wherein the arcuate arms have a thickness, the thickness of the arcuate arms at the end portions in the transition region being smaller than the thickness of the arcuate arms at the end portions in the compliant region.

15. The contact in accordance with claim 14 wherein the thickness of the arcuate arms at the end portions in the transition region are about 10% smaller than the thickness of the arcuate arms at the end portions in the compliant region.

16. An electrical connector assembly configured to engage an electrical component having an array of plated through-holes, the connector assembly comprising:

a dielectric structure having an array of cavities; and an array of electrical contacts, the contacts of the array being held in corresponding cavities of the dielectric structure and comprising a compressive body configured to be press-fit into a corresponding through-hole of the electrical component, the body including a center portion and a pair of opposing arcuate arms that extend along a central axis, the arcuate arms projecting from the center portion and being configured to bend toward each other when inserted into the through-hole, the arcuate arms forming a transition region and a compliant region, the transition and compliant regions having at least one of different sizes and different cross-sectional shapes;

wherein the array of contacts provides a tactile indication that the arcuate arms of the transition regions have been compressed within the corresponding prior to the compliant regions being inserted into the corresponding through-holes.

17. The connector assembly in accordance with claim 16 wherein each arcuate arm extends from the center portion to a corresponding end portion, the end portions of the transition region interfacing with the through-hole when the body is fully inserted therein, the end portions of the transition region being closer together than the end portions of the compliant region after the body is fully inserted into the hole.

18. The connector assembly in accordance with claim 16 wherein the transition region and the compliant region each have a maximum width that is measured between outer surfaces of the arcuate arms in the corresponding region, the maximum widths being substantially equal before the body is inserted into the through-hole.

19. The connector assembly in accordance with claim 16 further comprising a lead-in region that extends away from the transition region, the lead-in region having a cross-sectional shape that is smaller than the cross-sectional shape of the transition region.

20. The connector assembly in accordance with claim 16 wherein the arcuate arms of the transition regions are sized and shaped to bend when a first insertion force advances the transition regions into the corresponding through-holes, the arcuate arms of the compliant regions being sized and shaped to bend when a second insertion force then advances the compliant regions into the corresponding through-holes, the second insertion force being greater than the first insertion force, a difference between the first and second insertion forces providing the tactile indication.

* * * * *